US008133040B2

(12) United States Patent
Takagi et al.

(10) Patent No.: US 8,133,040 B2
(45) Date of Patent: Mar. 13, 2012

(54) FUEL PUMP AND METHOD OF MANUFACTURING THE SAME

(75) Inventors: Masatoshi Takagi, Takahama (JP); Motoya Ito, Hekinan (JP)

(73) Assignee: Denso Corporation, Kariya (JP)

( * ) Notice: Subject to any disclaimer, the term of this patent is extended or adjusted under 35 U.S.C. 154(b) by 393 days.

(21) Appl. No.: 12/409,746

(22) Filed: Mar. 24, 2009

(65) Prior Publication Data

US 2009/0297364 A1 Dec. 3, 2009

(30) Foreign Application Priority Data

May 28, 2008 (JP) ..... 2008-140165

(51) Int. Cl.
*F04B 39/14* (2006.01)
*F04B 39/12* (2006.01)

(52) U.S. Cl. ..... 417/410.1; 417/423.1; 417/423.14; 417/423.15

(58) Field of Classification Search ..... 417/410.1, 417/411, 423.1, 423.14, 423.15
See application file for complete search history.

(56) References Cited

U.S. PATENT DOCUMENTS

2004/0253125 A1* 12/2004 Kobayashi et al. ..... 417/410.1
2008/0063545 A1* 3/2008 Takagi et al. ..... 417/410.1

FOREIGN PATENT DOCUMENTS

JP 2008-215202 9/2008

* cited by examiner

*Primary Examiner* — Joseph L Williams
*Assistant Examiner* — Nathaniel Lee
(74) *Attorney, Agent, or Firm* — Nixon & Vanderhye PC

(57) ABSTRACT

A fuel pump includes a case member defining a fuel passage and a discharge-side cover connected to the case member and defining an outlet port. A pump section has an inlet port and is connected to the case member. A motor section is housed in the case member for driving the pump section. A positive electrode terminal and a negative electrode terminal are supported by an insulative terminal support member fixed to the discharge-side cover. Base portions of the positive and negative electrode terminals are covered by insulative portions. The insulative portions are fitted in fitting holes of the discharge-side cover. The discharge-side cover has guide portions on its inner surface. The terminal support member has engagement projections on opposite side walls thereof. The engagement projections are guided by the guide portions to restrict the discharge-side cover from rotating with respect to the terminal support member.

13 Claims, 14 Drawing Sheets

FUEL PUMP AND METHOD OF MANUFACTURING THE SAME

CROSS REFERENCE TO RELATED APPLICATION

This application is based on Japanese Patent Application No. 2008-140165 filed on May 28, 2008, the disclosure of which is incorporated herein by reference.

FIELD OF THE INVENTION

The present invention relates to a fuel pump and a method of manufacturing the same.

BACKGROUND OF THE INVENTION

An electric fuel pump having a pump section and a motor section within a case member is, for example, described in US Patent Application Publication No. 2008/0063545 (JP-A-2008-64027, JP-A-2008-64029). In such a fuel pump, fuel is suctioned from a fuel suction portion of the pump section. The fuel is increased in pressure through the pump section, and then flows through a peripheral area of the motor section. Then, the fuel is discharged to the outside of the fuel pump from a discharge port of a discharge-side cover disposed on an end of the motor section opposite to the pump section.

The pump section is supplied with electric power from an external power source through a terminal. The electric power supplied to the terminal is supplied to the motor section through brushes and a commutator. The fuel pump described in US2008/0063545 is adapted to be used in a gasoline-alternate fuel.

The gasoline-alternate fuel, such as high density alcohol fuel, bio-ethanol, ethanol 100% fuel and the like, has been recently in great demand. The gasoline-alternate fuel is hereinafter referred to as alcohol mixture fuel. The alcohol mixture fuel has electric conductivity higher than that of general fuel such as gasoline. In the fuel pump for the alcohol mixture fuel, therefore, it is required to restrict an electrical short circuit between a positive electrode terminal and a negative electrode terminal through the fuel when voltage is generated between the terminals and electrochemical corrosion of the terminals due to the terminals being exposed in the fuel.

SUMMARY OF THE INVENTION

The present invention is made in view of the foregoing matter, and it is an object of the present invention to provide a fuel pump capable of reducing electrochemical corrosion of terminals even used in a fuel containing a component with high electric conductivity. It is another object of the present invention to provide a method of manufacturing the fuel pump.

According to an aspect of the present invention, a fuel pump includes a case member a pump section, a motor section, a discharge-side cover, a positive electrode terminal, a negative electrode terminal, a terminal support member, a positive electrode insulative portion and a negative electrode insulative portion. The case member defines a fuel passage therein. The pump section defines an inlet port and is connected to the case member such that the inlet port is in communication with the fuel passage of the case member. The motor section is housed in the case member for driving the pump section. The discharge-side cover defines a discharge port. The discharge-side cover is connected to the case member such that the fuel passage is in communication with the discharge port. The positive electrode terminal and the negative electrode terminal each extend from an inside of the discharge-side cover for conducting electricity to the motor section. The terminal support member is insulative and is connected to the discharge-side cover. The terminal support member supports the positive electrode terminal and the negative electrode terminal. The positive electrode-side insulative portion covers a base portion of the positive electrode terminal. The negative electrode-side insulative portion covers a base portion of the negative electrode terminal. The discharge-side cover has a first fitting hole and a second fitting hole. The positive electrode-side insulative portion through which the positive electrode terminal passes is fitted in the first fitting hole. The negative electrode-side insulative portion through which the negative electrode terminal passes is fitted in the second fitting hole. The discharge-side cover further has a first guide portion and a second guide portion projecting from an inner surface of the discharge-side cover. The terminal support member has a first engagement projection and a second engagement projection on opposite side walls thereof. The first engagement projection and the second engagement projection are configured to be guided by the first guide portion and the second guide portion while restricting the discharge-side cover from rotating with respect to the terminal support member.

Accordingly, since the base portions of the terminal are covered with the insulative portions, it is less likely that the base portions of the terminals will contact fuel. Therefore, even if the fuel pump is used in an alcohol mixture fuel containing a component with high electric conductivity, damage to the terminals, such as electrochemical corrosions, is reduced. Further, the discharge-side cover is positioned to the terminal support member through engagement of the first and second guide portions of the discharge-side cover and the first and second engagement projections of the terminal support member. Accordingly, even when the insulative portions exist around the base portions of the terminals, the discharge-side cover is easily fixed to the terminal support member without interfering with the insulative portions. Thus, the electrochemical corrosion of the terminals is effectively reduced.

For example, a method of manufacturing the fuel pump includes assembling the discharge-side cover to the terminal support member. The assembling includes guiding the first and second engagement projections along the first and second guide portions, fitting the positive electrode-side insulative portion and the negative electrode-side insulative portion in the first fitting hole and the second fitting hole of the discharge-side cover, respectively, and inserting a fitted portion of an end of the discharge-side cover into the case member.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENT

An exemplary embodiment of the present invention will now be described with reference to FIGS. 1 to 21.

Referring to FIGS. 1 to 14, a fuel pump 1 of the present embodiment is an in-tank fuel pump mounted inside of a fuel tank of a vehicle and the like, for example. Thus, the fuel pump 1 is used in a condition where an entirety thereof is submerged in fuel. The fuel pump 1 serves to feed the fuel inside of the fuel tank to an engine of the vehicle. Here, the fuel is the alcohol mixture fuel containing a component having high electric conductivity, such as the high density alcohol fuel, bio-ethanol, ethanol 100% fuel and the like.

Figure 1:
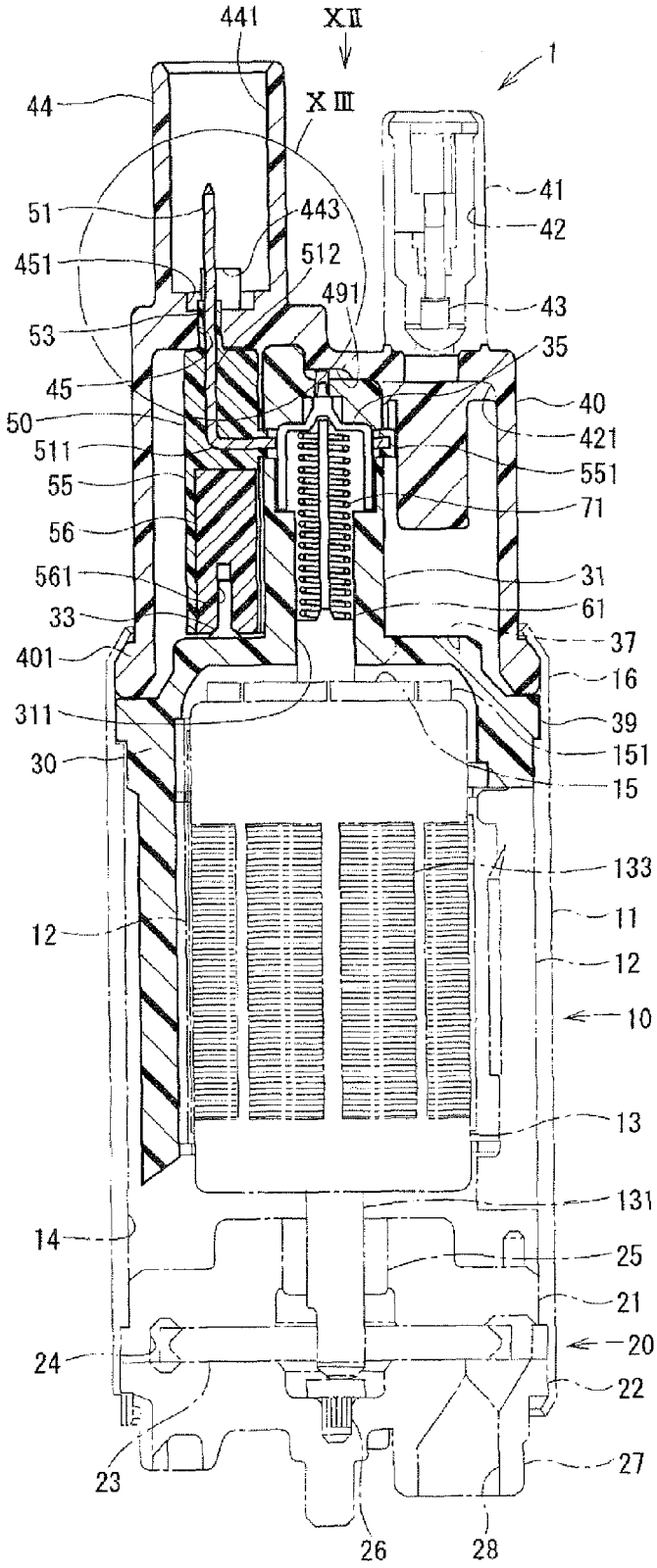
FIG. 1 is a schematic cross-sectional view of a fuel pump according to an embodiment of the present invention.

A schematic structure of the fuel pump 1 will be described first with reference to FIG. 1. In FIG. 1, components existing on a front side (near side) with respect to components shown in solid cross-section are shown by chain line for convenience of illustration.

The fuel pump 1 generally includes a motor section 10 and a pump section 20 driven by the motor section 10 to increase the fuel in pressure. The motor section 10 includes a direct current motor with brushes.

The fuel pump 1 has a substantially cylindrical housing 11. Inside of the housing 11, permanent magnets 12 are annually arranged along an inner surface of the housing 11 in a circumferential direction. An armature 13 is arranged radially inside of the annularly arranged permanent magnets 12 to be concentric with the permanent magnets 12. The armature 13 is accommodated to be rotatable in the inside of the housing 11.

The armature 13 generally includes a core 133 and a coil (not shown) wound around the outer periphery of the core 133. A disc-shaped commutator 15 is mounted to an axial end of the armature 13 on a side opposite to the pump section 20 with respect to an axial direction. The commutator 15 includes multiple commutator segments 151 arranged in a direction of rotation of the armature 13. The commutator segments 151 are made of carbon, for example. The commutator segments 151 are electrically insulated from one another via air gaps and an insulative resin material.

The pump section 20 generally includes a pump casing 21, a pump cover 22, an impeller 23, and the like. The pump casing 21 and the pump cover 22 form a pump passage 24 having a substantially C-shape therein. The impeller 23 is rotatably accommodated between the pump casing 21 and the pump cover 22. The pump casing 21 and the pump cover 22 are, for example, made by die casting of aluminum.

The pump casing 21 is fixed to a first axial end of the housing 11, such as by press-fitting. A bearing 25 is mounted at a center of the pump casing 21. The bearing 25 supports a first axial end of a shaft 131 of the armature 13 in its radially inside to be rotatable.

The pump cover 22 has a fuel suction portion 27. The fuel suction portion 27 is formed with a fuel suction port 28 for suctioning the fuel into the pump section 20. The pump cover 22 covers the pump casing 21 and is fixed to the first axial end of the housing 11, such as by crimping. The pump cover 22 is provided with a thrust bearing 26 at a center thereof. The thrust bearing 26 receives a load from the shaft 131 in the axial direction. The pump casing 21 and the housing 11 construct a case member of the fuel pump 1.

A bearing holder 30 and an end cover 40 as a discharge-side cover are provided at a second axial end of the housing 11, that is, on the opposite side of the pump cover 22 with respect to the armature 13. The baring holder 30 is fixed by being interposed between the end cover 40 and the housing 11. The end cover 40 has a fitted portion 401 at a first end thereof. The end cover 40 is fixed to the housing 11 by crimping the second axial end of the housing 11 over the fitted portion 401 of the end cover 40, for example. Further, a terminal subassembly 50 is fixed by being interposed between the bearing holder 30 and the end cover 40.

The terminal subassembly 50 includes a positive electrode terminal 51, a negative electrode terminal 52, relay terminals 511, 521, a molded body 55 as a terminal support member, and a coil holder 56. The positive electrode terminal 51 and the negative electrode terminal 52 are electrically connected to an external power source (not shown). The relay terminals 511, 521 are electrically connected to base portions 512, 522 of the terminals 51, 52, respectively. The coil holder 56 accommodates a choke coil 63 therein. Here, the relay terminal 521, which is not shown in FIG. 1, is present on a negative electrode side.

Figure 14:
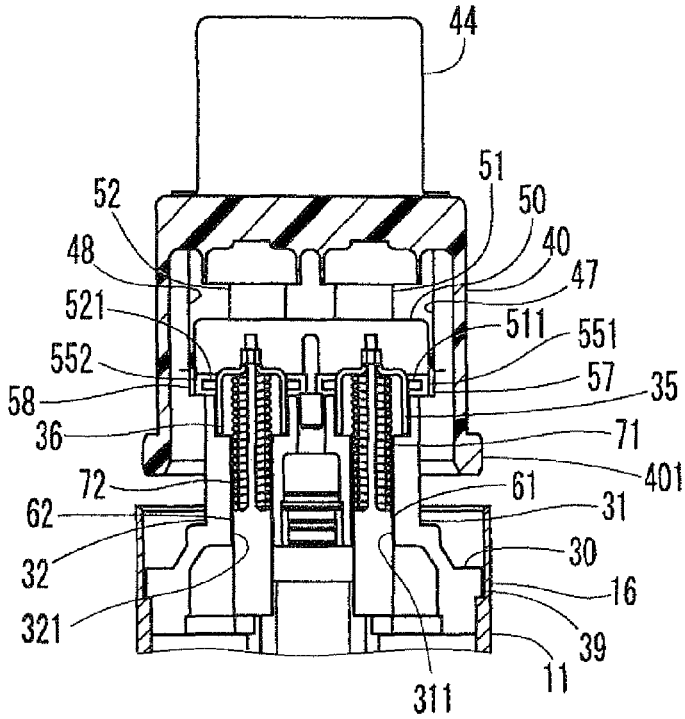
FIG. 14 is a cross-sectional view taken along a line XIV-XIV in FIG. 12 for explaining the beginning of a first step of an assembling process of the fuel pump according to the embodiment.
Figure 15:
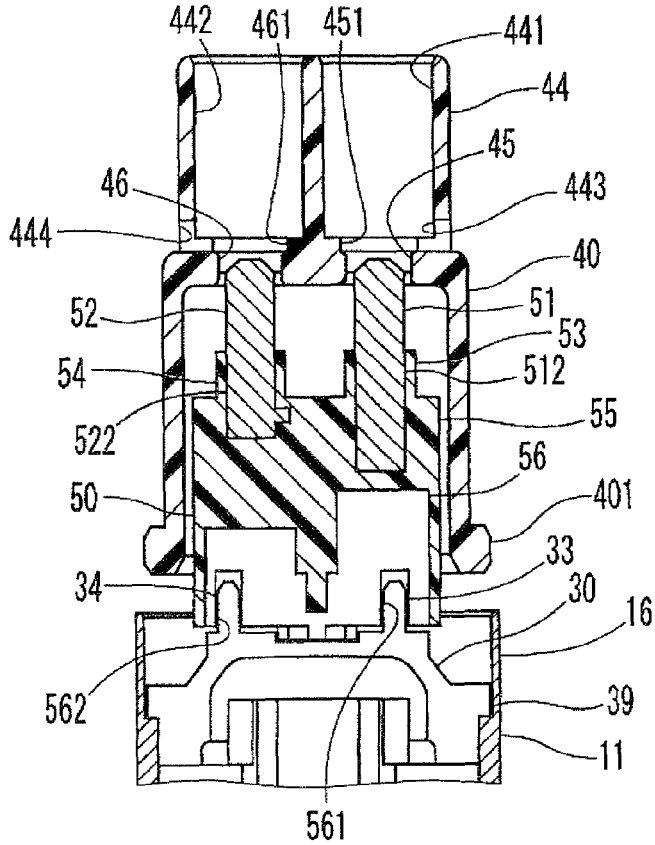
FIG. 15 is a cross-sectional view taken along a line XV-XV in FIG. 12 for explaining the beginning of the first step of the assembling process according to the embodiment.

The bearing holder 30 is provided with a bearing (not shown). The bearing of the bearing holder 30 supports a second axial end of the shaft 131 of the armature 13 in its radially inside to be rotatable, the second axial end being opposite to the pump cover 22 with respect to the armature 13. The baring holder 30 has brush holding portions 31, 32 and projections 33, 34 projecting in a direction opposite to the pump cover 22, as shown in FIGS. 14 and 15. The brush holding portions 31, 32 and the projections 33, 34 are integrally molded into the bearing holder 30. Further, the bearing holder 30 is formed with a hole 37 as a fuel passage to be in communication with an inner space 14 of the housing 11.

The projections 33, 34 are fitted in recesses 561, 562 of the coil holder 56, respectively, as shown in FIG. 15. The brush holding portions 31, 32 are formed with brush holding holes 311, 321, respectively, as shown in FIG. 14. The brush holding portions 31, 32 accommodate load bearing portions 35, 36 in the brush holding holes 311, 321, respectively. Brushes 61, 62 are disposed in the brush holding portions 31, 32, respectively, to be movable in the axial direction.

The brushes 61, 62 are biased toward the motor section 10 by first ends of brush springs 71, 72, respectively, to be in contact with the commutator 15. Second ends of the brush springs 71, 72 are in contact with the load bearing portions 35, 36 accommodated in the brush holding portions 31, 32, respectively.

Here, the brush holding portion 31, the brush holding hole 311, the projection 33, the recess 561, the brush 61 and the brush spring 71 are present on the positive electrode side. The brush holding portion 32, the brush holding hole 321, the projection 34, the recess 562, the brush 62 and the brush spring 72 are present on the negative electrode side. In FIG. 1, only the positive electrode side is shown in convenience of illustration.

The end cover 40 has a fuel discharge portion 41 at a second end thereof, which is opposite to the first end fitted n the housing 11. The fuel discharge portion 41 is formed with a fuel discharge port 42. A pipe (not shown) is coupled to the fuel discharge portion 41 for leading the fuel to the outside of the fuel pump 1. The fuel discharge portion 41 is provided with a check valve 43 for opening and closing the fuel discharge port 42.

Further, the end cover 40 has a connector housing portion 44 at the second end. The connector housing portion 44 is integrally molded into the end cover 40. The connector housing portion 44 is formed with spaces 441, 442, which are separated from one another. The positive electrode terminal 51 and the negative electrode terminal 52 are respectively separately disposed in the spaces 441, 442 so as to avoid an electrical short circuit between them. The end cover 40 forms a communication space 421 as a fuel passage therein to be in communication with the inner space 14 of the housing 11 through the hole 37 of the bearing holder 30.

Figure 2:
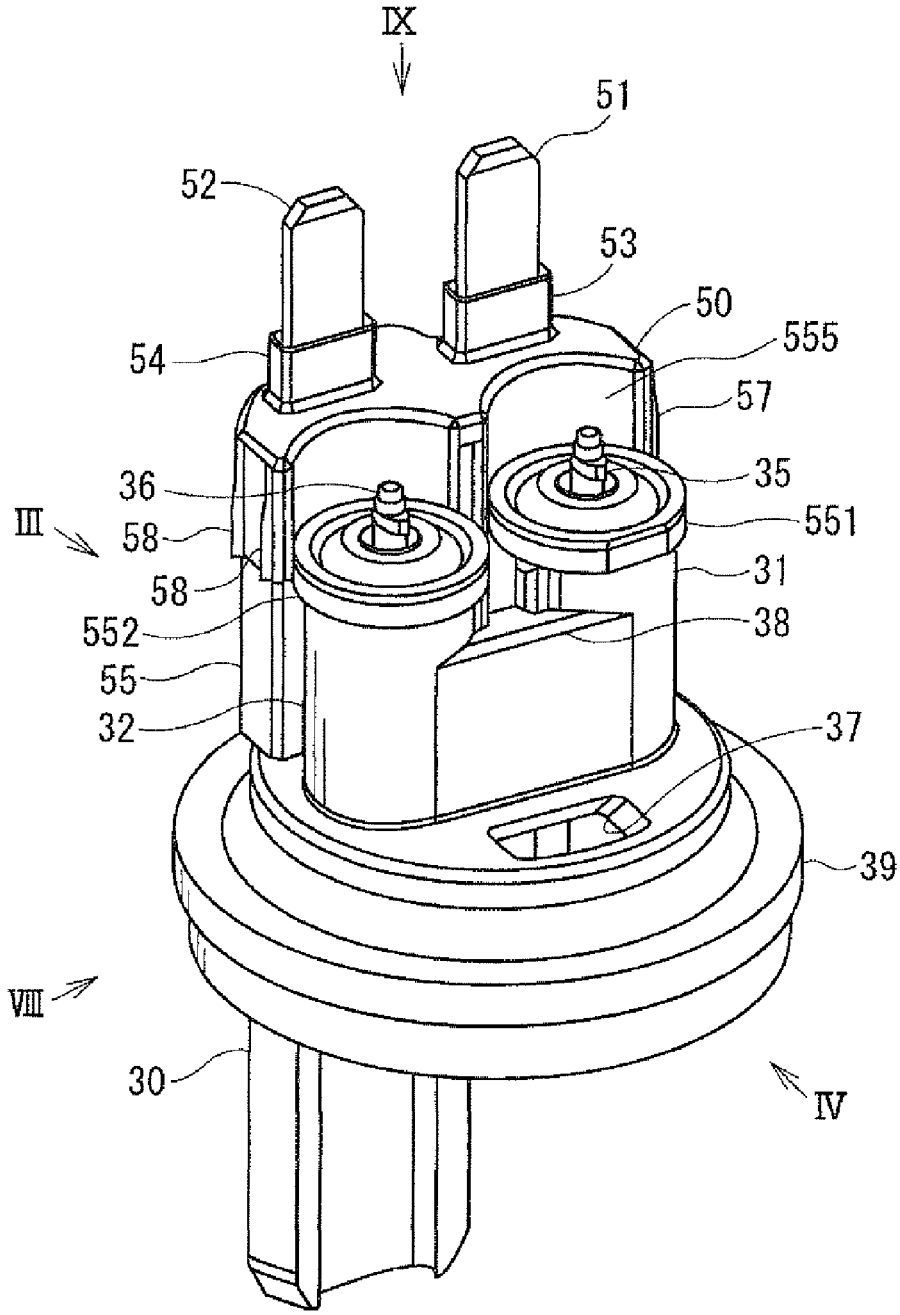
FIG. 2 is a perspective view of a terminal subassembly and a bearing holder of the fuel pump according to the embodiment.
Figure 3:
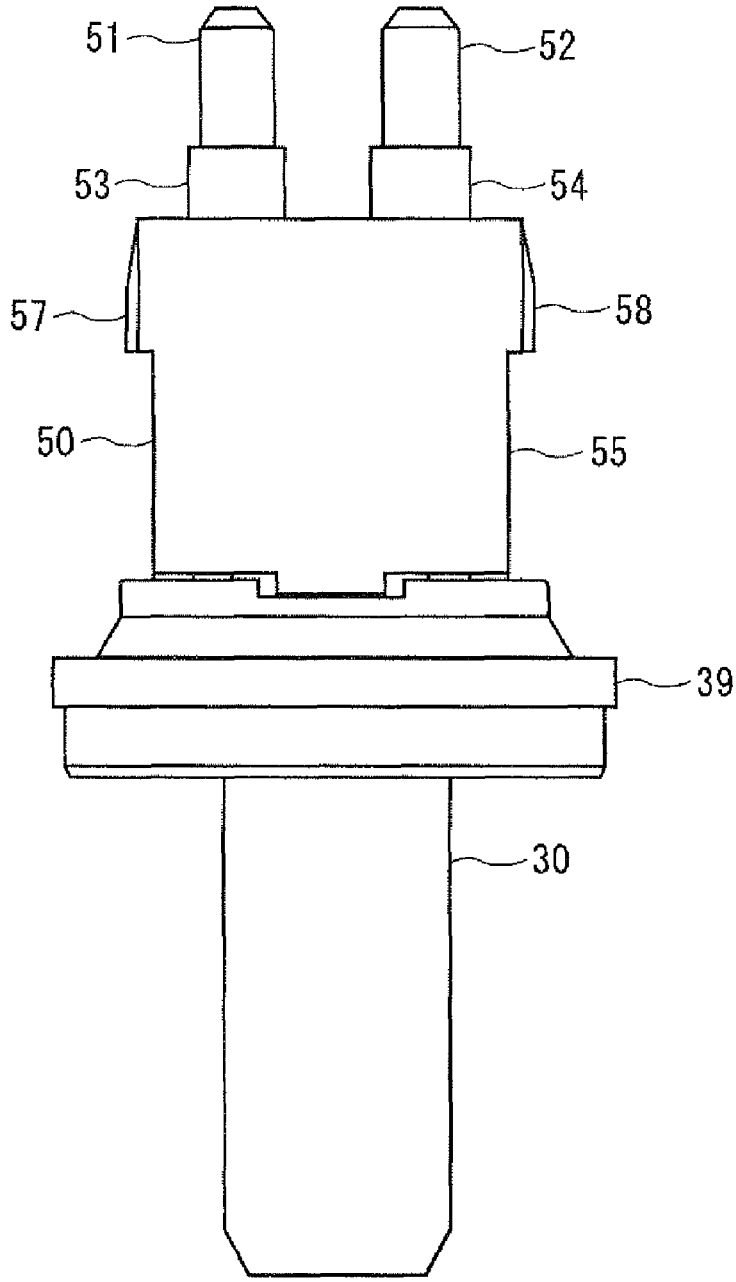
FIG. 3 is a side view of the terminal subassembly and the bearing holder when viewed along an arrow III in FIG. 2.
Figure 4:
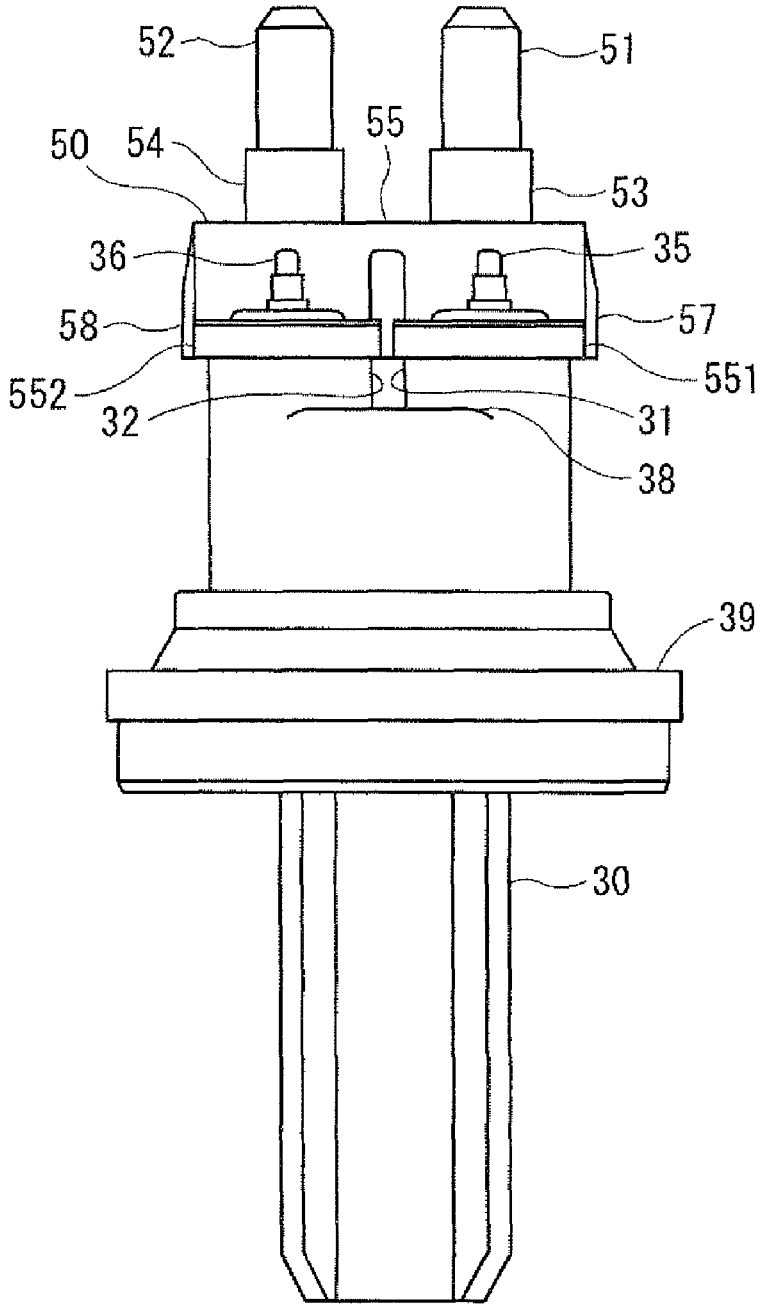
FIG. 4 is a side view of the terminal subassembly and the bearing holder when viewed along an arrow IV in FIG. 2.

Next, a structure of the terminal subassembly 50 will be described with reference to FIGS. 2 to 4. FIG. 2 shows the terminal subassembly 50 assembled to the bearing holder 30. FIG. 3 is a back view of the terminal subassembly 50 with the bearing holder 30 when viewed along an arrow III in FIG. 2. FIG. 4 is a front view of the terminal subassembly 50 with the bearing holder 30 when viewed along an arrow IV in FIG. 2. The structure shown in FIGS. 2 to 4 corresponds to the structure illustrated by the solid line in FIG. 1. Further, components, which have been described above with reference to FIG. 1, are designated with the same reference numerals, and a description thereof will not be repeated.

Outer peripheries of the base portions 512, 522 of the terminals 51, 52 are covered with a positive electrode-side insulative portion 53 and a negative electrode-side insulative portion 54, respectively. The insulative portions 53, 54 are, for example, made of resin and project from a body portion 555 of the molded body 55. The base portions 512, 522 of the terminals 51, 52 are sealed without clearances.

The molded body 55 has positive electrode-side guide nails 57 as first engagement projections and negative electrode-side guide nails 58 as second engagement projections on opposite side walls of the body portion 555. The positive electrode-side guide nails 57 are projections. The width of each projection, that is, the amount of each projection in a direction perpendicular to the axial direction is reduced toward an end adjacent to the positive electrode terminal 51, and is increased toward an opposite end adjacent to the bearing holder 30. The positive electrode-side guide nails 57 have the same shape and are arranged parallel to each other. For example, the molded body 55 has two positive electrode-side guide nails 57 extending in the axial direction along opposite ends of the side wall of the body portion 555.

The negative electrode-side guide nails 58 are formed similar to the positive electrode-side guide nails 57. Thus, when the molded body 55 is viewed along the arrow III in FIG. 2, the positive electrode-side guide nails 57 and the negative electrode-side guide nails 58 are symmetric with each other with respect to a longitudinal axis of the fuel pump 1, as shown in FIG. 3.

The relay terminals 511, 521 are disposed on outer peripheries of the brush holding portions 31, 32. The relay terminals 511, 521 are respectively molded in annular portions 551, 552, which are integrally molded with the molded body 55. Inside of the molded body 55, the relay terminals 511, 521 are electrically connected to the brushes 61, 62, respectively.

A bearing housing portion 38 is formed between the bearing holding portions 31, 32 of the bearing holder 30. The bearing housing portion 38 holds a bearing (not shown) therein.

Figure 5:
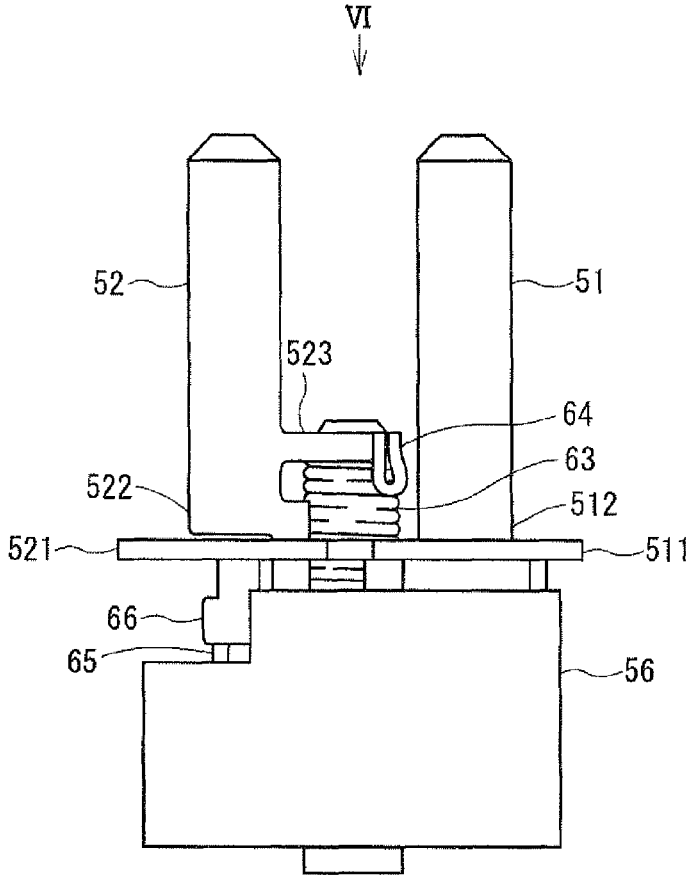
FIG. 5 is a side view of the terminal subassembly of FIG. 4 before being molded.
Figure 6:
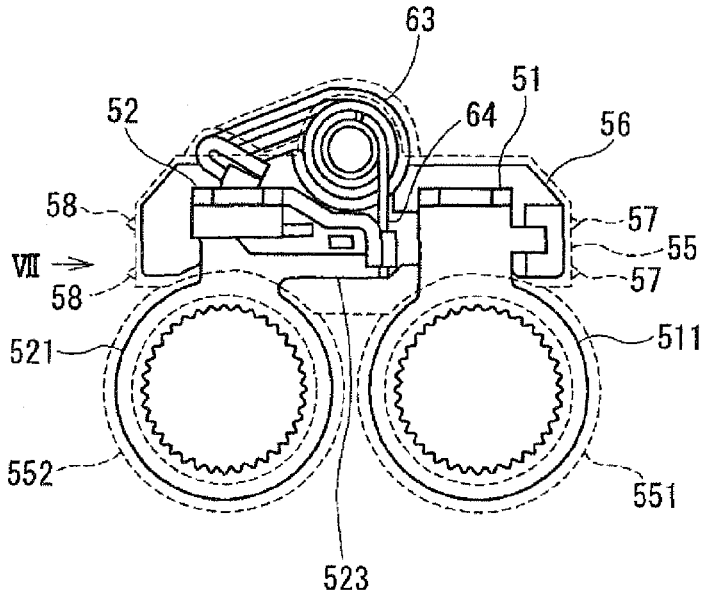
FIG. 6 is an end view of the terminal subassembly when viewed along an arrow VI in FIG. 5.
Figure 7:
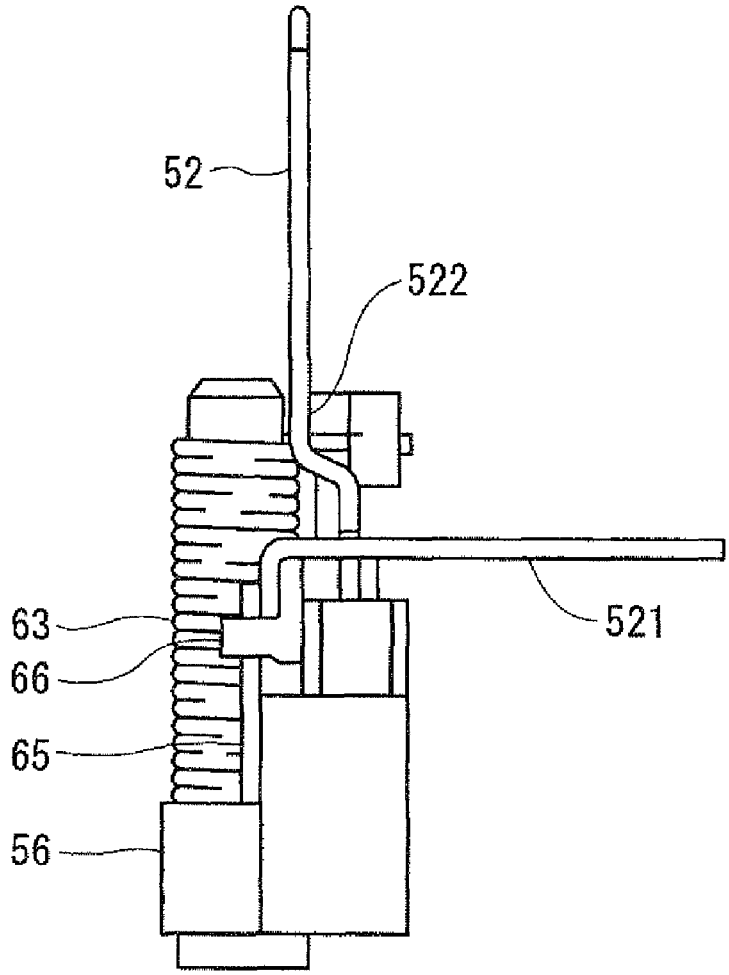
FIG. 7 is a side view of the terminal subassembly when viewed along an arrow VII in FIG. 6.

Next, a method of manufacturing the terminal subassembly 50 will be described with reference to FIGS. 5 to 7. FIG. 5 shows the terminal subassembly 50 shown in FIG. 4, but before being molded with the molded body 55. FIG. 6 shows the terminal subassembly 50 when viewed along an arrow VI in FIG. 5. FIG. 7 shows the terminal subassembly 50 when viewed along an arrow VII in FIG. 6.

As shown in FIGS. 5 to 7, the negative electrode terminal 52 has a terminal connecting portion 523 extending toward a center portion of the terminal subassembly 50. The terminal connecting portion 523 is electrically connected to a first coil connecting portion 64 extending from a first end of the choke coil 63, which is held by the coil holder 56. A second coil connecting portion 65 extending from a second end of the choke coil 63 is electrically connected to a brush connecting portion 66 extending from the negative electrode-side brush 62.

As shown by dashed lines in FIG. 6, the molded body 55 is formed by molding a resin to surround radially outside of the relay terminals 511, 521 and cover the choke coil 63. When the molded body 55 is molded, the base portions 512, 522 of the terminals 51, 52 are sealed by the insulative portions 53, 54, which have a predetermined thickness and a predetermined length in a direction in which the terminals 51, 52 project, such as in the axial direction. At the same time, the positive electrode-side guide nails 57 and the negative electrode-side guide nails 58 are integrally molded into the molded body 55.

After molded by the molded body 55, the terminal subassembly 50 is lightly fitted and positioned to the bearing holder 30 in which the brushes 61, 62, the brush springs 71, 72 and the like are accommodated. At this time, the projections 33, 34 of the bearing holder 30 are inserted into the recesses 561, 562 of the coil holder 56, respectively, as shown in FIG. 15.

Figure 8:
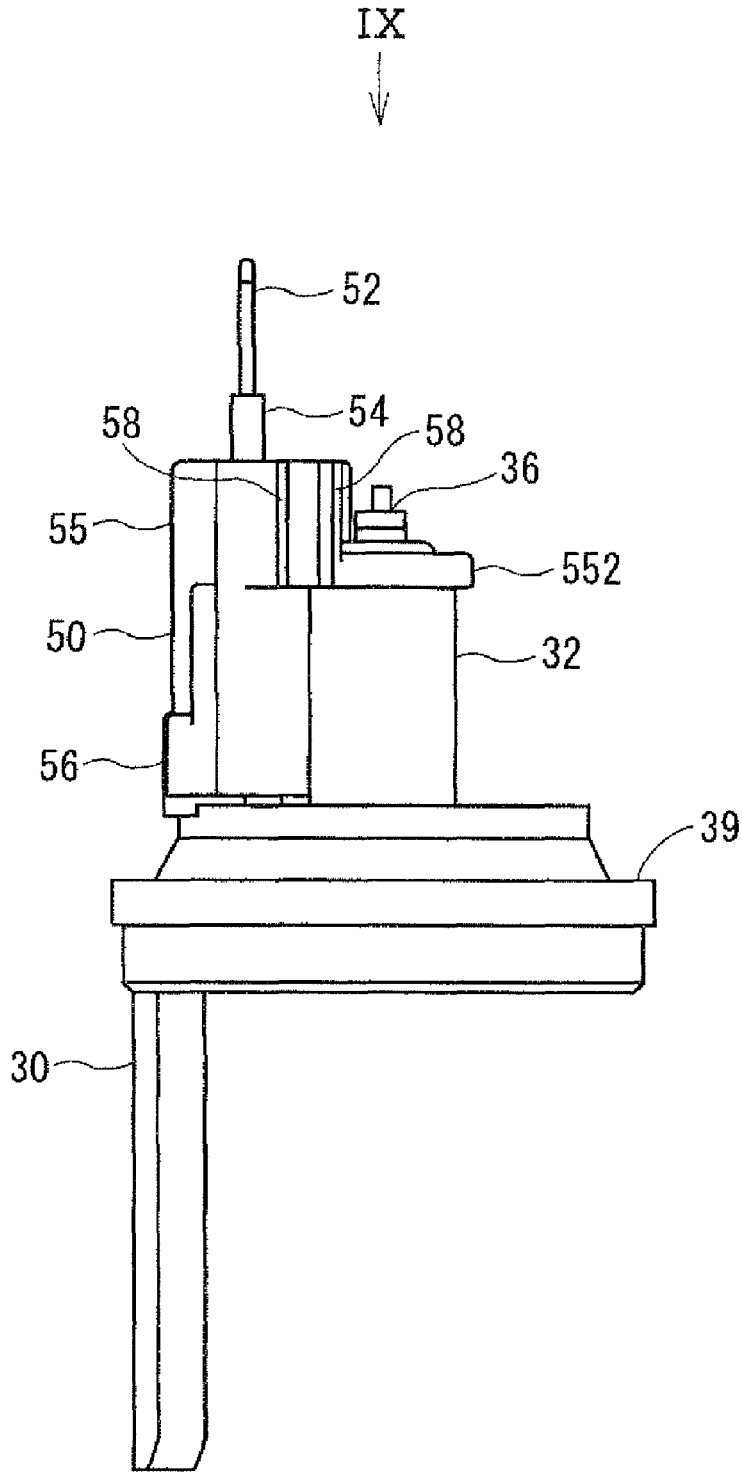
FIG. 8 is a side view of the terminal subassembly and the bearing holder when viewed along an arrow VIII in FIG. 2.
Figure 9:
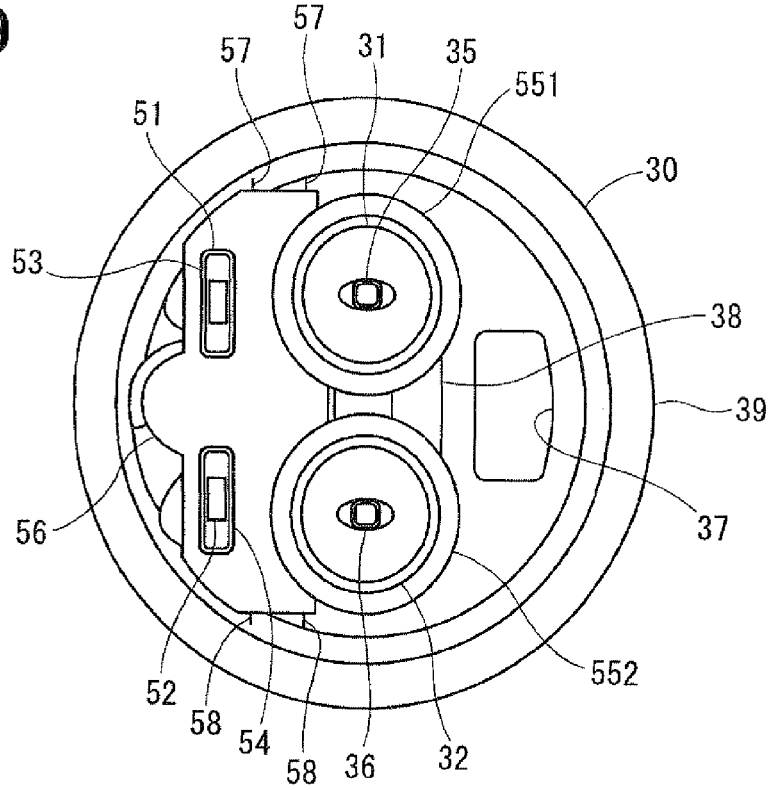
FIG. 9 is an end view of the terminal subassembly and the bearing holder when viewed along an arrow IX in FIG. 8.

FIGS. 8 and 9 show a condition where the terminal subassembly 50 has been integrated with the bearing holder 30. FIG. 8 shows the terminal subassembly 50 with the bearing holder 30 when viewed along an arrow VIII in FIG. 2. FIG. 9 shows the terminal subassembly 50 with the bearing holder 30 when viewed along an arrow IX in FIG. 8.

The baring holder 30 has a fitted portion 39 at an end portion to be fitted in the housing 11. The fitted portion 39 is an annular projection projecting radially outside of the bearing holder 30. During assembling, the fitted portion 39 is fitted in a fitting portion 16 of the housing 11, and is then interposed between the end cover 40 and the housing 11, as shown in FIGS. 14 to 19. Thus, the bearing holder 30 is fixed to the housing 11.

Figure 10:
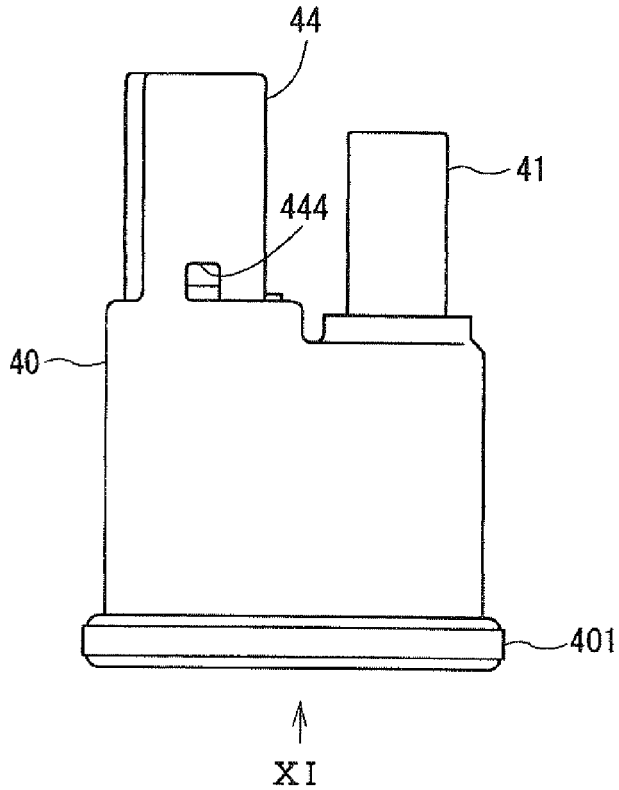
FIG. 10 is a side view of an end cover of the fuel pump according to the embodiment of the present invention.

Next, a structure of the end cover 40 will be described with reference to FIGS. 10 and 11. FIG. 10 shows the end cover 40 when viewed along the same direction as FIG. 8. The end cover 40 is assembled to the terminal subassembly 50 and the bearing holder 30 in the direction of an arrow IX in FIG. 8 to cover the terminal subassembly 50 and the bearing holder 30.

The fitted portion 401 of the end cover 40 has substantially the same diameter as the fitted portion 39 of the bearing holder 30. When the end cover 40 is assembled, a lower surface of the fitted portion 401 of the end cover 40 contacts an upper surface of the fitted portion 39 of the bearing holder 30.

The connector housing portion 44 of the end cover 40 is formed with apertures 443, 444. The apertures 443, 444 are in communication with the spaces 441, 442 and are open in the radially outward direction of the connector housing portion 44, respectively. The connector housing portion 44 is capable of receiving external connectors, such as an external connector 90 shown in FIG. 13, in the spaces 441, 442 to be connected to the positive electrode terminal 51 and the negative electrode terminal 52, respectively.

Figure 11:
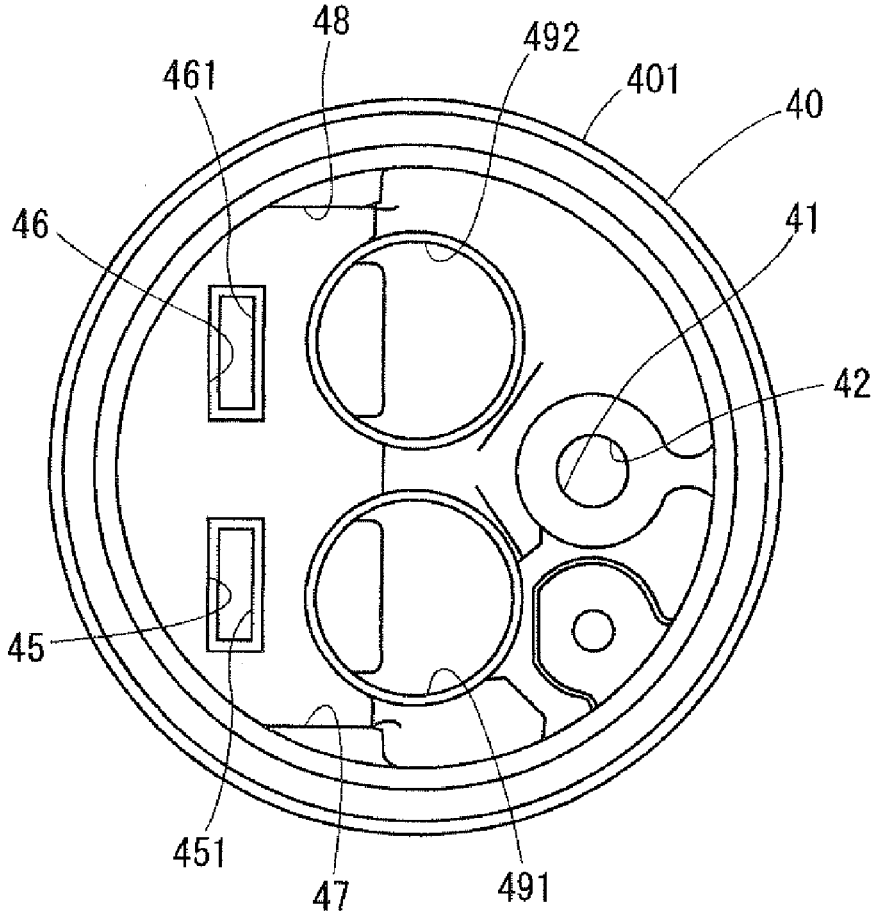
FIG. 11 is an end view of the end cover when viewed along an arrow XI in FIG. 10.

FIG. 11 shows the end cover 40 when viewed along an arrow XI in FIG. 10. The end cover 40 is formed with spaces 491, 492. The brush holding portions 31, 32 are inserted in the spaces 491, 492, respectively. The end cover 40 is further formed with a first fitting hole 45 and a second fitting hole 46. The positive electrode-side insulative portion 53 through which the positive electrode terminal 51 passes is press-fitted in the first fitting hole 45. The negative electrode-side insulative portion 54 through which the negative electrode terminal 52 passes is press-fitted in the second fitting hole 46.

The end cover 40 has a first guide wall 47 as a first guide portion and a second guide wall 48 as a second guide portion on an inner surface thereof. The molded body 55 of the terminal subassembly 50 is assembled to the end cover 40 while the positive electrode-side guide nails 57 and the negative electrode-side guide nails 58 are being guided along the first guide wall 47 and the second guide wall 48, respectively.

The first guide wall 47 and the second guide wall 48 are formed as projections projecting toward an inside of the end cover 40 and opposed to each other across a space. The first guide wall 47 and the second guide wall 48 provide opposed walls opposed in a direction perpendicular to the axial direction at a predetermined distance, for example. The body portion 555 of the molded body 55 is inserted in the space provided between the first and second guide walls 47, 48 while the guide nails 57, 58 are being guided along the first and second guide walls 47, 48.

Figure 12:
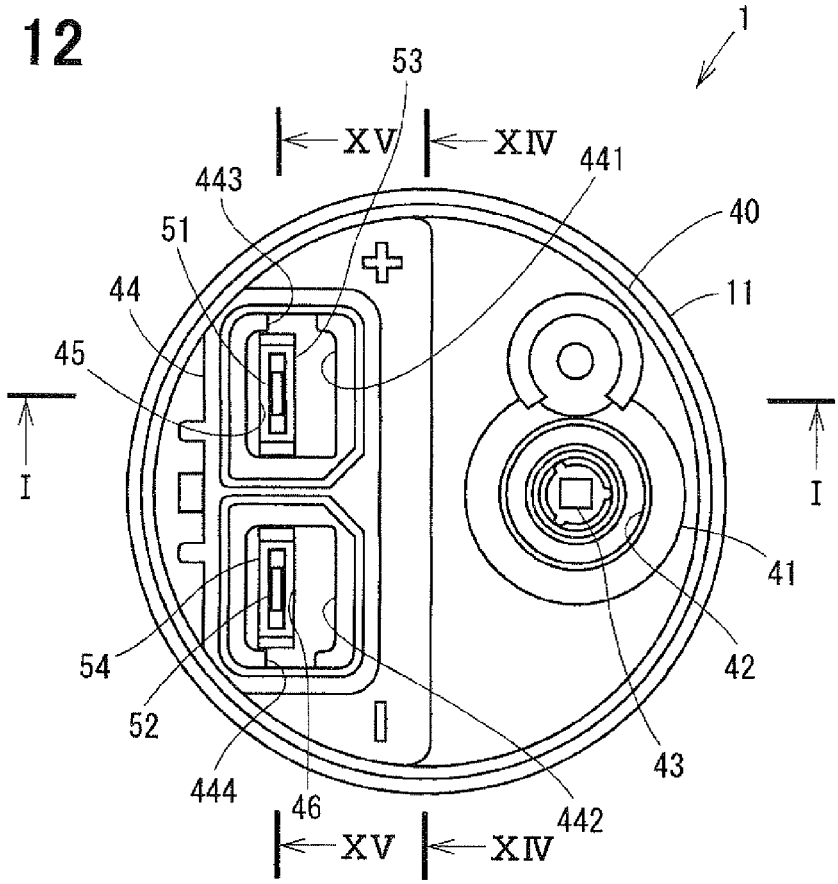
FIG. 12 is an end view of the fuel pump when viewed along an arrow XII in FIG. 1.
Figure 13:
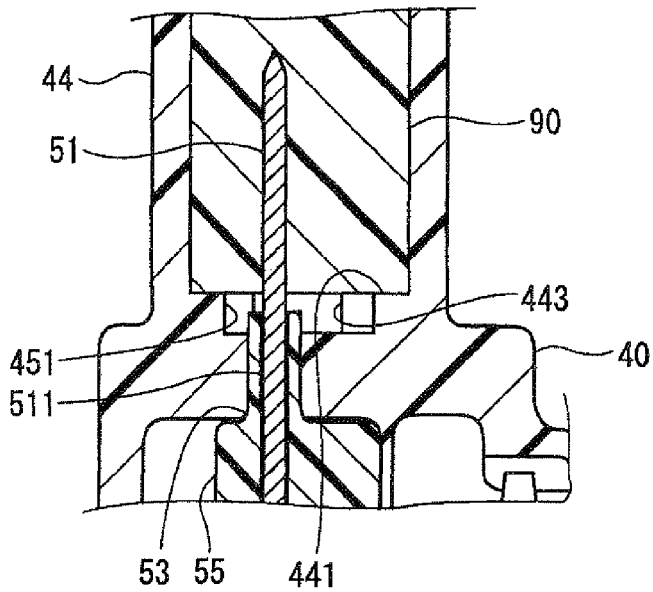
FIG. 13 is a cross-sectional view of a part XIII of the fuel pump in FIG. 1, in a condition where an external connector is connected to a connector housing of the fuel pump, according to the embodiment.

FIG. 12 shows an end view of the fuel pump 1 when the above described members are assembled to each other. FIG. 13 shows a condition where the positive electrode-side insulative portion 53 is fitted in the first fitting hole 45, and the external connector 90 is connected to the positive electrode terminal 51 in the connector housing portion 44.

The first fitting hole 45 is in communication with the space 441 of the connector housing portion 44 through a first communication hole 451. Likewise, the second fitting hole 46 is in communication with the space 442 of the connector housing portion 44 through a second communication hole 461.

The positive electrode-side insulative portion 53 has the predetermined length in the terminal projecting direction, such as in the axial direction, so that an upper end thereof is located within the first communication hole 451 without reaching the space 441. Likewise, the negative electrode-side insulative portion 54 has the predetermined length in the terminal projecting direction, such as in the axial direction, so that an upper end thereof is located within the second communication hole 461 without reaching the space 442.

Therefore, as shown in FIG. 13, it is less likely that each insulative portion 53, 54 will interfere with the external connector 90 when the external connector 90 is inserted in the space 441, 442 of the connector housing portion 44. Further, the insulative portions 53, 54 are closely sealed with inner surfaces of the fitting holes 45, 46, respectively, by press-fitting. Thus, it is less likely that the fuel will leak between the insulative portions 53, 54 and the fitting holes 45, 46.

A method of assembling the end cover 40 to the housing 11 and the terminal subassembly 50 while using positioning means through the guide nails 57, 58 and the guide walls 47, 48 will be described with reference to FIGS. 14 to 21.

As shown in FIGS. 14 and 15, the end cover 40 is positioned to the terminal subassembly 50 such that the guide walls 47, 48 correspond to the guide nails 57, 58. In this case, since the guide nails 57, 58 are guided along the guide walls 47, 48 of the inside of the end cover 40, rotation of the end cover 40 with respect to the terminal subassembly 50 is restricted. (first step)

Figure 16:
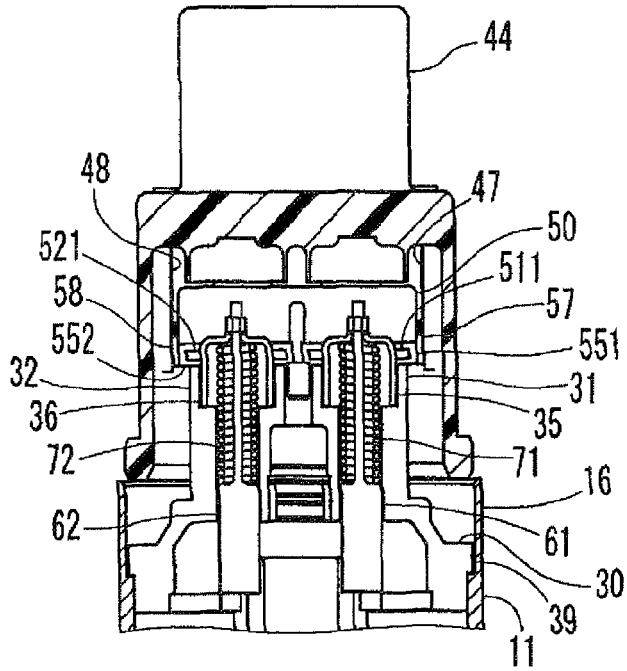
FIG. 16 is a cross-sectional view taken along the line XIV-XIV in FIG. 12 for explaining the beginning of a third step of the assembling process according to the embodiment.
Figure 17:
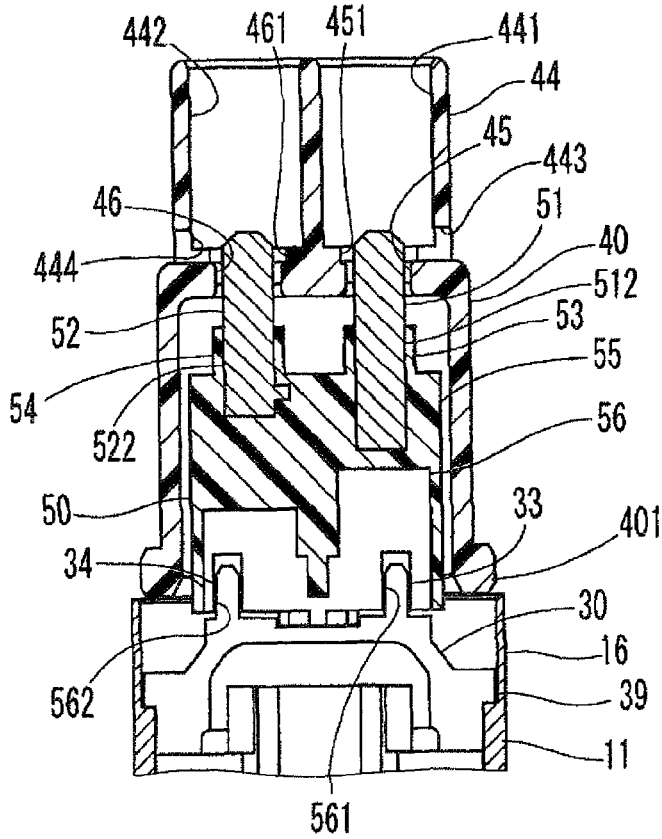
FIG. 17 is a cross-sectional view taken along the line XV-XV in FIG. 12 for explaining the beginning of the third step of the assembling process according to the embodiment.

As shown in FIGS. 16 and 17, when the full length of the guide nails 57, 58 is received in the space between the guide walls 47, 48, the fitted portion 401 of the end cover 40 begins to be inserted in the housing fitting portion 16 of the housing 11 (third step). That is, the length of the guide walls 47, 48 in a guiding direction, such as in the axial direction, is set to the predetermined length such that the insertion of the fitted portion 401 of the end cover 40 into the housing fitting portion 16 begins when the guide nails 57, 58 has been fully guided in the space between the guide walls 47, 48. For example, an axial length between a lower end of the guide walls 47, 48 and the lower surface of the fitted portion 401 of the end cover 40 is substantially equal to a distance between a lower end of the guide nails 57, 58 and a top end of the housing fitting portion 16.

Figure 18:
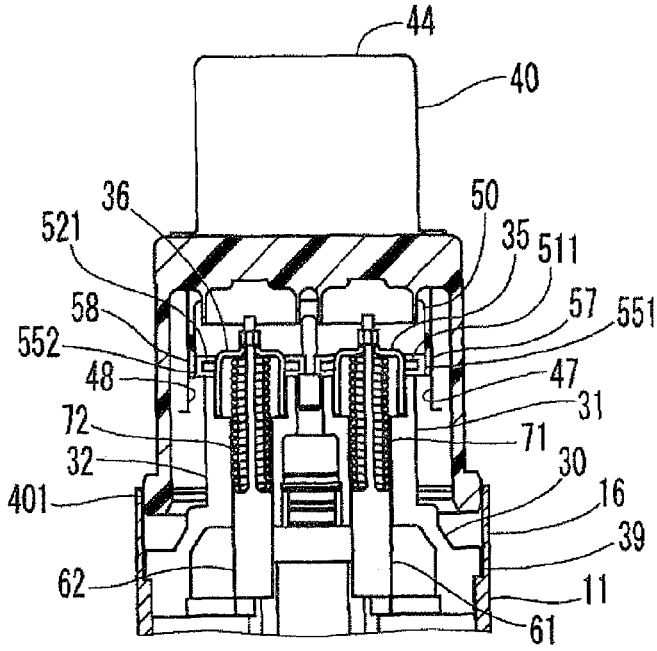
FIG. 18 is a cross-sectional view taken along the line XIV-XIV in FIG. 12 for explaining the beginning of a second step of the assembling process according to the embodiment.
Figure 19:
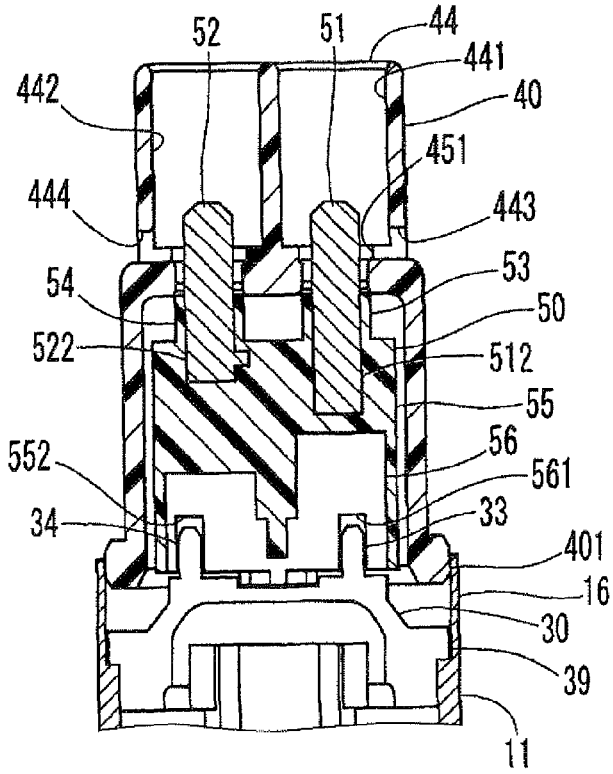
FIG. 19 is a cross-sectional view taken along the line XV-XV in FIG. 12 for explaining the beginning of the second step of the assembling process according to the embodiment.

As shown in FIGS. 18 and 19, the positive electrode terminal 53 and the negative electrode terminal 54 begin to be fitted into the first fitting hole 45 and the second fitting hole 46, respectively (second step). In this condition, the fitted portion 401 of the end cover 40 is still being inserted in the fitting portion 16 of the housing 11.

Figure 20:
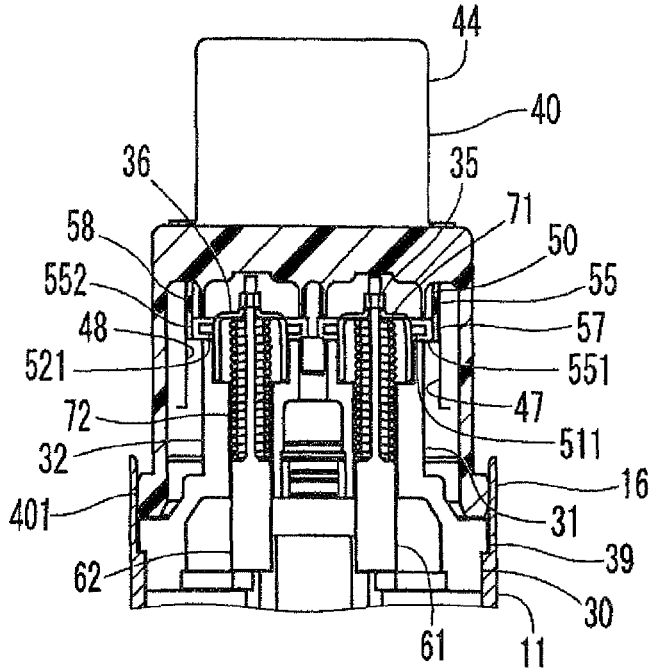
FIG. 20 is a cross-sectional view taken along the line XIV-XIV in FIG. 12 after assembled by the assembling process according to the embodiment.
Figure 21:
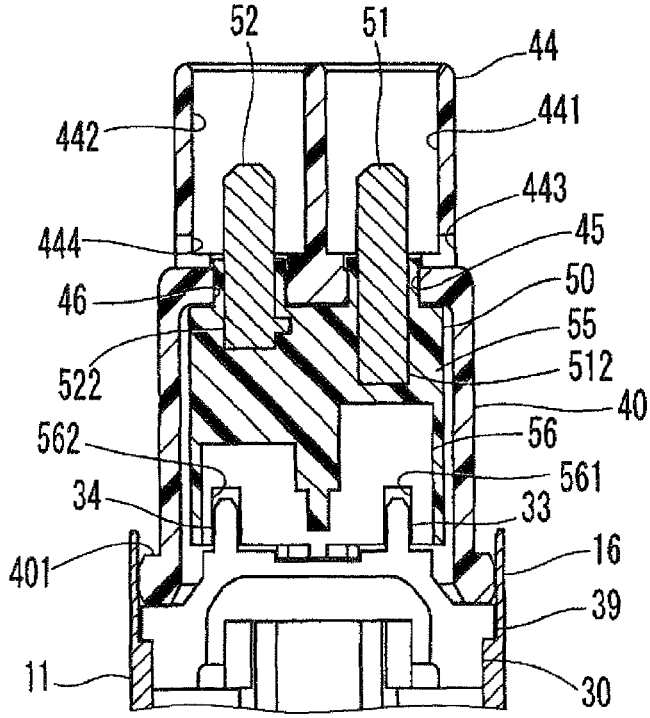
FIG. 21 is a cross-sectional view taken along the line XV-XV in FIG. 12 after assembled by the assembling process according to the embodiment.

From the condition shown in FIGS. 18 and 19 to a condition shown in FIGS. 20 and 21, the fitting of the insulative portions 53, 54 into the fitting holes 45, 46 and the insertion of the fitted portion 401 of the end cover 40 into the housing 40 can be simultaneously performed. The insulative portions 53, 54 are inserted in the fitting holes 45, 46, for example, by press-fitting. The fitted portion 401 of the end cover 40 is inserted in to the housing fitting portion 16, for example, by press-fitting.

After the step of FIGS. 20 and 21 is completed, the housing fitting portion 16 is crimped over an outer surface of the fitted portion 401 of the end cover 40. Thus, the end cover 40 is fixed to the housing 11. In this way, the assembling of the fuel pump 1 is completed.

Next, an operation of the fuel pump 1 will be described with reference to FIG. 1. The fuel pump 1 supplies fuel from the inside of the fuel tank to the outside of the fuel tank. As the impeller 23 is rotated in the fuel passage 24 of the pump section 20, the fuel is suctioned into the pump passage 24 through the fuel inlet port 28 of the fuel inlet portion 27. In the pump passage 24, the fuel is raised in pressure in accordance with the rotation of the impeller 23, and is introduced to the inner space 14 of the housing 11.

When fuel pressure inside of the fuel pump 1 exceeds a predetermined pressure, the check valve 43 of the fuel discharge portion 41 is released. Thus, the fuel passes through the hole 37 of the bearing holder 30, the communication space 421 of the end cover 40, and flows out from the fuel pump 1 through the fuel discharge port 42.

The impeller 23 rotates with the rotation of the shaft 131 of the armature 13. The armature 13 is rotated when the coil thereof is supplied with electric power through the commutator 15, which is in contact with the brushes 61, 62 biased by the brush springs 71, 72. The commutator 15 rotates with the armature 13 while maintaining a contact state with the brushes 61, 62. Electric power is supplied to the terminals 51, 52 from the power source (not shown), and is further supplied to the brushes 61, 62 through pigtails (not shown). At the same time, the electric power is also supplied to the choke coil 63 from the terminal 52. The choke coil 63 reduces electric noise generated when the brushes 61, 62 slide on the commutator segments 151.

Here, the fuel pump 1 is fully submerged in the alcohol mixture fuel. Since the alcohol mixture fuel has high electric conductivity, if the above described components, which form electric supply paths, contact the alcohol mixture fuel, electrical short will occur between such components and the components will be electrochemically corroded. Therefore, in the fuel pump used in the alcohol mixture fuel, it is necessary to restrict the electrical short circuit and the electrochemical corrosion of the components.

In the present embodiment, the bearing holder 30, the molded body 55 of the terminal subassembly 50 and the end cover 40 are made of resin, and connecting portions therebetween are closely sealed with each other such as by press-fitting and the like.

If the sealing between the connecting portions is insufficient, particularly, if the positive electrode terminal 51 is in contact with the fuel, electrochemical corrosion is likely to easily occur. In the resent embodiment, the base portion 512 of the positive electrode terminal 51 and the base portion 522 of the negative electrode terminal 52 are molded by the positive electrode-side insulative portion 53 and the negative electrode-side insulative portion 54, respectively. Accordingly, it is less likely that the base portions 512, 522 will be electrochemically corroded.

Further, the positive electrode-side insulative portion 53 and the negative electrode-side insulative portion 54, which are made of resin, are respectively press-fitted in the first fitting hole 45 and the second fitting hole 46 of the end cover 40, which is made of resin. Therefore, base portions of the terminals 51, 52 are fully sealed. Accordingly, it is less likely that the fuel inside of the fuel tank will leak toward the terminals 51, 52 in the connector housing 44. Namely, it is less likely that electric conductive portions will contact the fuel.

The insulative portions 53, 54 each have the predetermined length to avoid interference with the external connector 90 when the external connector 90 is inserted in the connector housing 44. Namely, the external connector 90 can be electrically connected to the terminal 51, 52 without being interfered with the insulative portions 53, 54.

Further, the guide walls 47, 48 and the guide nails 57, 58 have the predetermined lengths to enable the above structures including the insulative portions 53, 54 and to ease the positioning of the end cover 40 to the terminal subassembly 50 without causing a twisting force while the resinous portions are being press-fitted. During the assembling, since the guide nails 57, 58 are guided along the guide walls 47, 48, the end cover 40, the terminal subassembly 50 and the housing 11 accommodating the motor section 10 and the like therein are simultaneously aligned with each other and press-fitted at the same time. That is, the end cover 40, the terminal assembly 50 and the housing 11 are properly and easily assembled at the same time.

Accordingly, the fuel pump 1, which is capable of reducing the electrochemical corrosion of the terminals even if the fuel contains the component with high electric conductivity, can be manufactured by the above discussed manufacturing method.

OTHER EMBODIMENTS

In the above embodiment, the fuel pump 1 is configured to be used in the fuel containing the component having high electric conductivity. However, the fuel pump 1 can be also used in general gasoline.

Additional advantages and modifications will readily occur to those skilled in the art. The invention in its broader term is therefore not limited to the specific details, representative apparatus, and illustrative examples shown and described.

What is claimed is:

1. A fuel pump comprising:

a case member defining a fuel passage therein;

a pump section defining an inlet port, the pump section connected to the case member such that the inlet port is in communication with the fuel passage of the case member;

a motor section housed in the case member, the motor section configured to drive the pump section;

a discharge-side cover defining a discharge port, the discharge-side cover connected to the case member such that the discharge port is in communication with the fuel passage;

a positive electrode terminal and a negative electrode terminal each extending from an inside of the discharge-side cover to an outside of the discharge-side cover for conducting electricity to the motor section;

a terminal support member being insulative and connected to the discharge-side cover and disposed inside of the discharge-side cover, the terminal support member supporting the positive electrode terminal and the negative electrode terminal;

a positive electrode-side insulative portion covering a base portion of the positive electrode terminal, the positive electrode-side insulative portion projecting from the terminal support member; and a negative electrode-side insulative portion covering a base portion of the negative electrode terminal, the negative electrode-side insulative portion projecting from the terminal support member, wherein the discharge-side cover has a first fitting hole and a second fitting hole, the positive electrode-side insulative portion through which the positive electrode terminal passes is fitted in the first fitting hole, the negative electrode-side insulative portion through which the negative electrode terminal passes is fitted in the second fitting hole, the discharge-side cover further has a first guide portion and a second guide portion on an inner surface thereof, the inner surface defining the inside of the discharge-side cover where the terminal support member is disposed, the terminal support member has a first engagement projection and a second engagement projection on opposite side walls thereof, and the first engagement projection and the second engagement projection are configured to be guided by the first guide portion and the second guide portion while restricting the discharge-side cover from rotating with respect to the terminal support member.

2. The fuel pump according to claim 1, wherein the positive electrode-side insulative portion and the negative electrode-side insulative portion are integrally molded with the terminal support member.

3. The fuel pump according to claim 1, wherein the discharge-side cover has a connector housing portion, the connector housing portion defines a first space and a second space therein, the second space being separate from the first space, the positive electrode terminal projects to the first space and the negative electrode terminal projects to the second space, the positive electrode-side insulative portion has a predetermined length without reaching inside of the first space, and the negative electrode-side insulative portion has a predetermined length without reaching inside of the second space.

4. The fuel pump according to claim 3, wherein the first space is continuous from the first fitting hole, and the second space is continuous from the second fitting hole.

5. The fuel pump according to claim 1, wherein the discharge-side cover has a fitted portion at an end received in the case member, the fitted portion projects from an outer surface of the end and has an annular shape, the first and second guide portions each has a predetermined length in a longitudinal direction of the positive electrode terminal such that the fitted portion of the discharge-side cover begins to be inserted in the housing when the first and second engagement projections are fully received between the first and second guide portions with respect to the longitudinal direction.

6. The fuel pump according to claim 1, wherein the discharge-side cover has a fitted portion at an end received in an end of the case member, a distance between an end of each of the first and second guide projections and the end of the case member is substantially equal to a distance between an end of each of the first and second guide portions and an end surface of the fitted portion with respect to a longitudinal direction of the positive electrode terminal.

7. The fuel pump according to claim 1, wherein the first guide portion and the second guide portion project from the inner surface of the discharge-side cover and provide a space therebetween, the terminal support member has a body portion in which the positive electrode terminal and the negative electrode terminal are supported, the first engagement projection and the second engagement projection are provided on opposite side walls of the body portion, the body portion is received in the space provided between the first guide portion and the second guide portion, and the first engagement projection and the second engagement projection are engaged with the first guide portion and the second guide portion, respectively.

8. The fuel pump according to claim 7, wherein the first and second engagement projection each include two nail portions projecting from the side wall of the body portion toward the discharge-side cover, the two nail portions extend in a longitudinal direction of the positive electrode terminal along opposite ends of the side wall of the body portion.

9. The fuel pump according to claim 8, wherein a width of each nail portion reduces as a function of distance from the case member.

10. A method of manufacturing the fuel pump according to claim 1, comprising assembling the discharge-side cover to the terminal support member, the assembling comprising:

guiding the first engagement projection and the second engagement projection of the terminal support member along the first guide portion and the second guide portion of the discharge-side cover, respectively;

fitting the positive electrode-side insulative portion and the negative electrode-side insulative portion in the first fitting hole and the second fitting hole of the discharge-side cover, respectively; and inserting a fitted portion of an end of the discharge-side cover into the case member.

11. The method according to claim 10, wherein the guiding is begun at least before the fitting is begun, and thereafter the fitting is begun during the guiding.

12. The method according to claim 10, wherein the guiding is begun at least before the fitting is begun, and thereafter the inserting is begun during the guiding.

13. The method according to claim 10, wherein the fitting and the inserting are performed simultaneously.

* * * * *